US006877743B2

(12) United States Patent
Van Den Berg et al.

(10) Patent No.: US 6,877,743 B2
(45) Date of Patent: Apr. 12, 2005

(54) ACCUMULATION DEVICE WITH PIVOT ROLLER

(75) Inventors: René Van Den Berg, Ej Groningen (NL); Herve Duval, Paris (FR)

(73) Assignee: Neopost Industrie, Bagneux (FR)

( * ) Notice: Subject to any disclaimer, the term of this patent is extended or adjusted under 35 U.S.C. 154(b) by 128 days.

(21) Appl. No.: 10/353,031

(22) Filed: Jan. 29, 2003

(65) Prior Publication Data

US 2003/0155700 A1 Aug. 21, 2003

(30) Foreign Application Priority Data

Jan. 31, 2002 (FR) ..... 02 01129

(51) Int. Cl.[7] ..... B65H 5/06

(52) U.S. Cl. ..... 271/273; 271/189; 271/272; 271/274; 53/569; 53/284.3

(58) Field of Search ..... 271/272, 273, 271/274, 189, 207; 53/569, 284.3

(56) References Cited

U.S. PATENT DOCUMENTS

| | | | | |
|---|---|---|---|---|
| 4,826,383 A | | 5/1989 | Millen | |
| 5,265,866 A | * | 11/1993 | Greive | 271/225 |
| 5,507,129 A | * | 4/1996 | Joson et al. | 53/55 |
| 5,577,718 A | * | 11/1996 | Hatch | 270/1.01 |
| 5,727,923 A | * | 3/1998 | Michel | 414/789.9 |
| 5,785,638 A | * | 7/1998 | Bristo et al. | 493/420 |
| 5,871,433 A | | 2/1999 | Lehmann et al. | |
| 6,226,959 B1 | | 5/2001 | Krasuski et al. | |

FOREIGN PATENT DOCUMENTS

EP 1 060 905 A2 12/2000

* cited by examiner

*Primary Examiner*—Patrick H. Mackey
(74) *Attorney, Agent, or Firm*—Sughrue Mion, PLLC

(57) ABSTRACT

This invention relates to a document accumulation device comprising an accumulation receptacle provided with a mobile accumulation guide for receiving a bundle of documents to be folded and drive means constituted by a motor roller driven in rotation by motor means and associated with a free counter-roller adapted to pivot about a pivot pin, in order, on the one hand, to drive and align these documents one after the other against the accumulation guide and, on the other hand, thereafter to eject in one go the bundle of documents thus formed by accumulation in said receptacle, this device further comprising displacement means, constituted by an electro-magnet of which the core having two positions of displacement is connected to a piece supporting said free counter-roller, in order to position these drive means, on the one hand, in a first position in which they are subjected to a rathermore weak drive effort to ensure drive and alignment of the documents and, on the other hand, in a second position in which they are subjected to a rathermore strong drive effort to ensure ejection of the bundle of documents.

15 Claims, 3 Drawing Sheets

ACCUMULATION DEVICE WITH PIVOT ROLLER

FIELD OF THE INVENTION

The present invention relates to the domain of document handling and more particularly to a document accumulation device equipping a folding and insertion machine.

BACKGROUND OF THE INVENTION

An example of architecture of a document folding and inserting machine is illustrated in Applicants' French Patent Application FR 2 782 673.

This type of machine conventionally comprises at least two feed bins, one for receiving the documents to be folded and the other the envelopes in which these documents will be inserted, and a folding mechanism incorporating a plurality of folding receptacles each provided with a mobile folding guide. On the document travel path there is further arranged an accumulation device for the prior assembling into a bundle of a plurality of documents having to be placed in the same envelope. This accumulation device conventionally comprises an accumulation receptacle provided with a mobile accumulation guide and a roller and counter-roller drive assembly which ensures both the successive accumulation of the documents and their ejection in one go towards the folding mechanism.

Now, the inventors have observed that the function of accumulation requires a rathermore weak drive effort of the rollers in order not to deform the documents during transport thereof and when they are aligned against the mobile receptacle bottom guide, while the function of ejection of the bundle of accumulated documents requires, on the contrary, a rathermore strong drive effort in order to eject this bundle suitably towards the folding receptacles.

It is therefore an object of the present invention to provide a document accumulation device which responds to these two contradictory objects, by optimalizing drive, alignment and ejection of the documents assembled in an accumulation receptacle.

SUMMARY OF THE INVENTION

These objects are attained by a document accumulation device comprising an accumulation receptacle provided with a mobile accumulation guide for receiving a bundle of documents to be folded and drive means constituted by a motor roller driven in rotation by motor means and associated with a free counter-roller adapted to pivot about a pivot pin, in order, on the one hand, to drive and align these documents one after the other against the accumulation guide and, on the other hand, thereafter to eject in one go the bundle of documents thus formed by accumulation in said receptacle, characterized in that it further comprises displacement means, constituted by an electro-magnet of which the core having two positions of displacement is connected to a piece supporting said free counter-roller, in order to position these drive means, on the one hand, in a first position in which they are subjected to a rathermore weak drive effort to ensure drive and alignment of the documents and, on the other hand, in a second position in which they are subjected to a rathermore strong drive effort to ensure ejection of the bundle of documents.

With this particular configuration, the differentiation of the drive efforts during the phases of accumulation and of ejection is thus preserved and the heretofore existing offsets at the moment of gripping the bundle of documents are avoided. The following folding is consequently perfect and the envelope may then be closed without difficulty.

The connection between the support piece and the core of the electro-magnet may advantageously be ensured via an elastic means and said motor roller is driven in rotation by a step-by-step motor and it comprises a spiral spring to absorb the starting torque transmitted by this step-by-step motor.

The displacement of the core of the electro-magnet is preferably effected by control means which also ensure the control of said motor means and of said mobile accumulation guide.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 3:
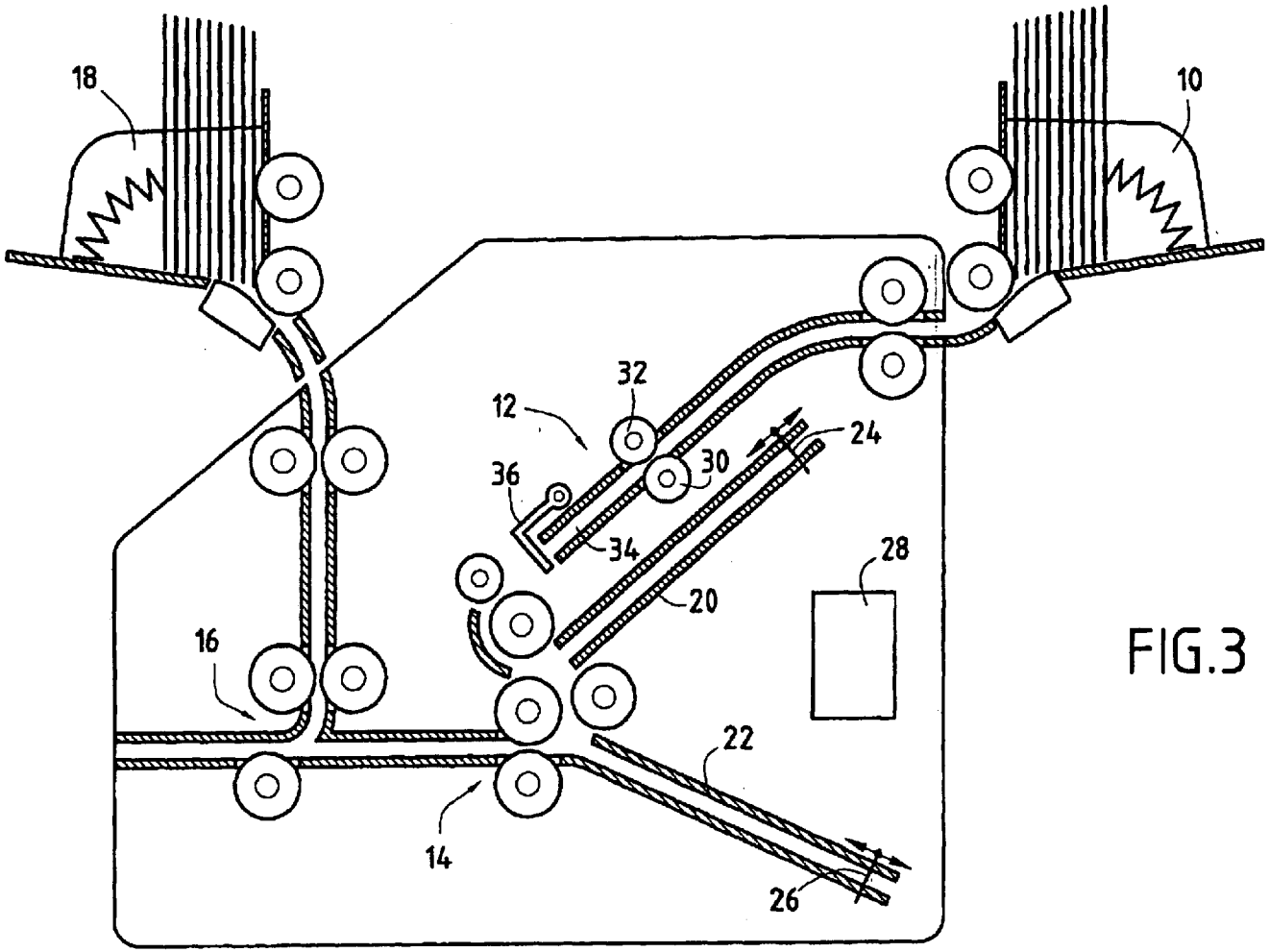

Referring now to the drawings, FIG. 3 illustrates a folding and insertion machine in very simplified manner. It comprises a bin 10 intended to receive documents to be folded, an accumulation device 12 for forming, if necessary, a bundle of documents, and a folding mechanism 14 for folding these documents before they are inserted (by an insertion module 16) in an envelope delivered by a bin 18 intended to receive envelopes. The folding mechanism comprises various rollers which drive the document or documents to be folded into folding receptacles, preferably two receptacles 20, 22, each comprising a mobile folding guide 24, 26 which can be adjusted depending on the desired dimensions of fold. The accumulation device comprises drive means constituted by a pair of accumulation rollers 30, 32 which drive the documents to be folded into an accumulation receptacle 34 comprising at its end a mobile accumulation guide 36. The rollers and guides are controlled from a control module 28, advantageously incorporating a microprocessor, as a function of folding data entered via a keyboard of the machine (not shown). However, it will be noted that, when this machine is connected to an outside member, for example a franking machine or a personal computer, these data may come directly from this outside member. It will also be noted that this folding and insertion machine may be connected directly at the exit of a document printer which is in that case arranged in place of the document feed bin 10.

Figure 1:
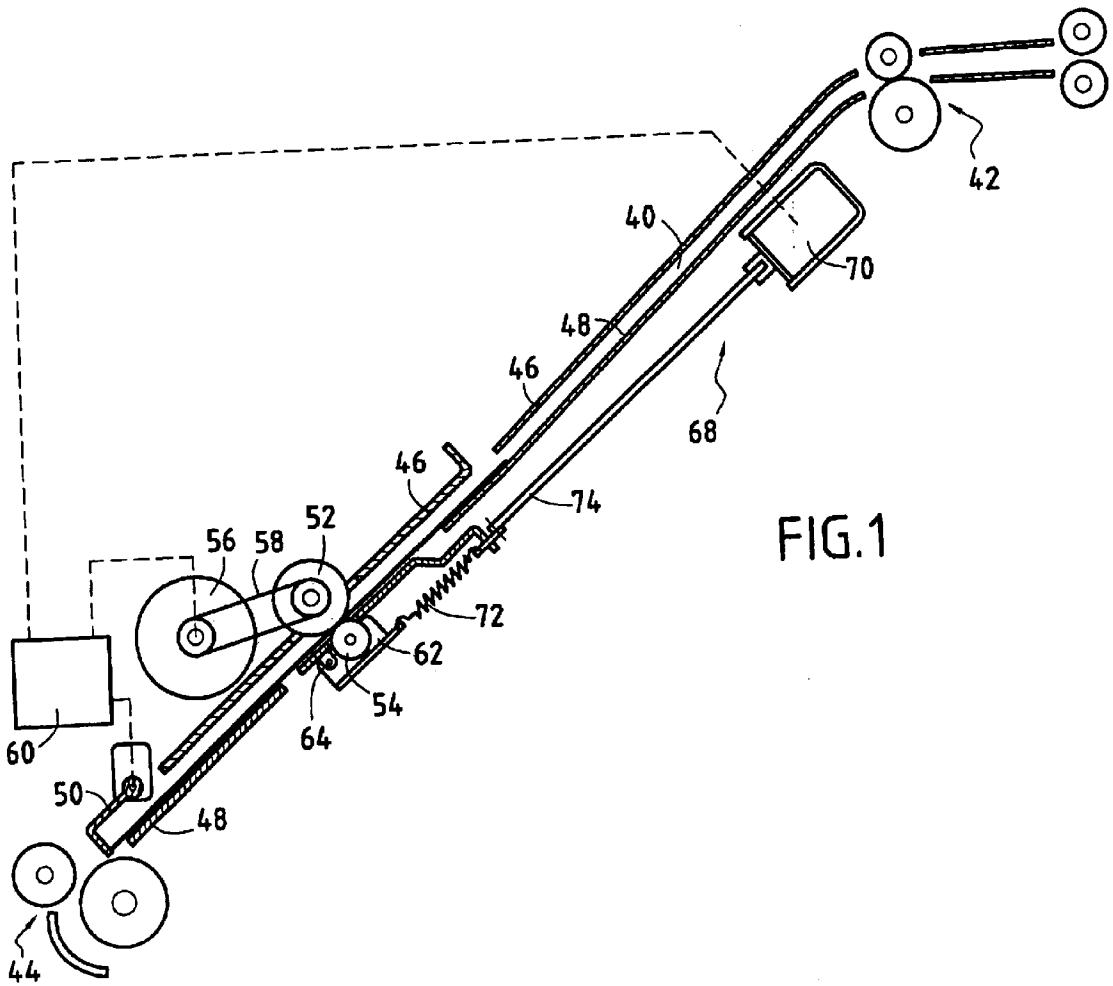
FIG. 1 is a view in longitudinal section of an accumulation device according to the invention.

FIG. 1 illustrates a document accumulation device according to the invention which may be integrated in a conventional folding and insertion machine.

This device is, in principle, installed on a path of travel 40 of these documents between a first pair of motor rollers 42 at the entrance of the machine and a second pair of motor rollers 44 at the entrance of the folding mechanism 14. This path of travel is materialized by two parallel support plates 46, 48 which form the upper and lower surfaces of an accumulation receptacle in which the documents to be folded together will be stored. This receptacle is closed downstream (with respect to the direction of advance of the documents on the path of travel) by a mobile accumulation guide 50. It is traversed, at about one third of its length, by a pair of accumulation rollers forming motor roller 52 and free counter-roller 54, the motor roller being driven in rotation by conventional motor means 56, of the step-by-step motor type for example, via a belt 58. This motor roller advantageously comprises a spiral spring (not shown) to absorb the relatively high starting torque transmitted by this step-by-step motor and which progressively tightens before driving the roller in rotation, cancelling the sudden initial thrust.

Control means 60 control the rotation of the motor 56 and the tipping of the mobile guide 50 as a function of the advance of the documents detected by different sensors (not shown) detecting the presence of documents, conventionally disposed along the path of travel of these documents 40 and the accumulation receptacle.

Figure 2:
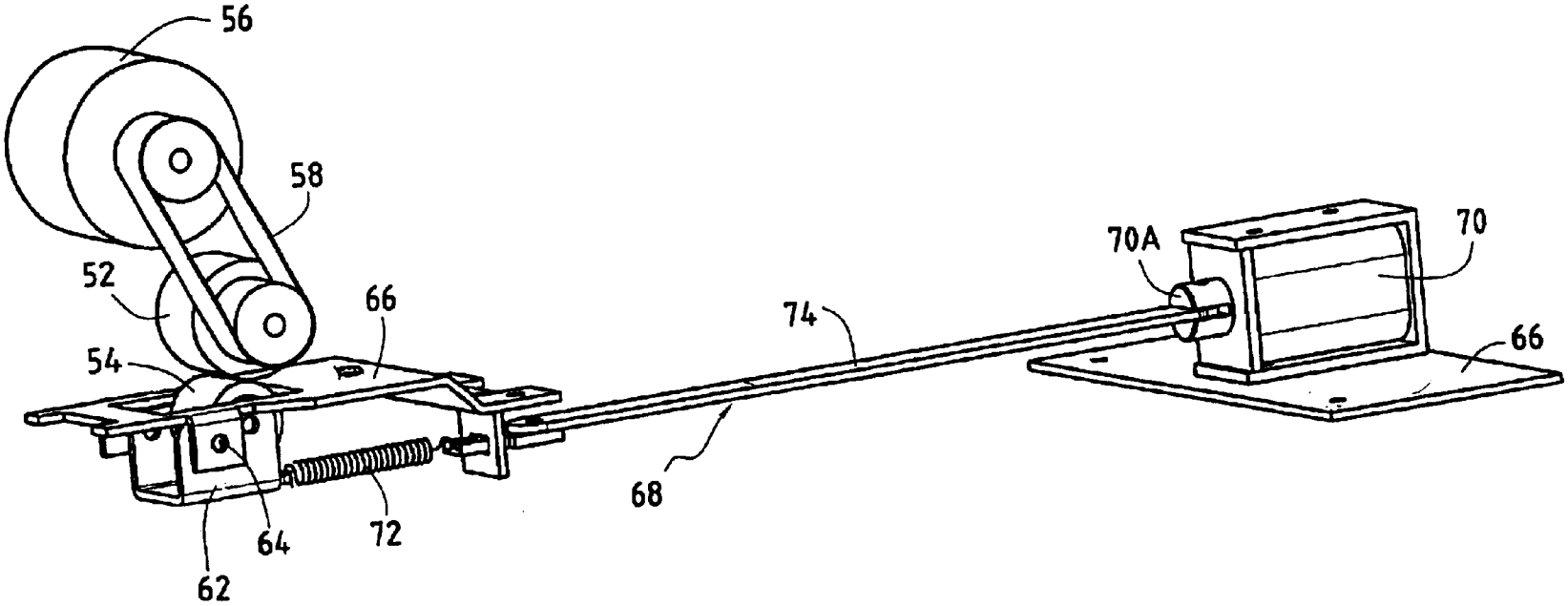
FIG. 2 is a view in perspective of certain of the elements constituting the accumulation device of FIG. 1, and FIG. 3 schematically shows a conventional folding and insertion machine.

According to the invention, and as illustrated in FIG. 2, the counter-roller 54 is mounted on a support piece 62 in the form of a fork joint pivoting about a pivot pin 64 fast with the frame, or chassis 66, of the machine, against the motor roller 52. Pivoting of the support piece 62 is obtained by displacement means 68 which, in the example illustrated, comprise an electro-magnet 70 of which the core 70A is connected to a first end of an elastic means 72 of spring type, via a rod 74, the second end of this spring being connected to the support piece 62 of the counter-roller 54. Displacement of the core of the electro-magnet is controlled by the control means 60 so as to define two distinct positions of the support piece 62 corresponding to two different efforts of pressure of the counter-roller on the motor roller and therefore to two distinct drive efforts. These two efforts of pressure correspond, in the example illustrated, to two different stresses of the spring 72, a first in which the spring is stretched slightly (the rod 74 exerting a minimum traction on the spring), and a second in which this spring is stretched more greatly and provokes pivoting of the support. It will be noted that the example illustrated is in no way limiting and, depending on the architecture of the machine and in particular the available space, it may be envisaged to connect the support piece directly to the electro-magnet.

With the present invention, the accumulation of the documents may be effected under a rathermore weak drive effort (the displacement means are in the first position) which does not deform the documents, while their ejection, once the bundle of documents is formed, is, on the contrary, effected under a rathermore strong drive effort (the displacement means are in that case in the second position) which is much bigger that the previous one.

What is claimed is:

1. A document accumulation device comprising:

an accumulation receptacle for receiving a plurality of documents therein;

a moveable accumulation guide for selectively blocking an end of the accumulation receptacle to retain the plurality of documents;

drive means for driving and aligning the plurality of documents sequentially against the accumulation guide and for subsequently ejecting the plurality of documents accumulated in the receptacle as a bundle, the drive means comprising a motor, a motor roller driven to rotate by the motor, and a freely rotating counter roller mounted to pivot towards and away from a position opposite the motor roller; and displacement means for displacing the drive means between a first arrangement in which the drive means provide a first drive force for driving the plurality of documents, and a second arrangement in which the drive means provides a second drive force stronger than the first drive force for driving the plurality of documents together as a bundle out of the accumulation receptacle.

2. The device according to claim 1, wherein in the first arrangement of the drive means, the motor roller and the counter roller are farther apart than in the second arrangement of the drive means.

3. The device according to claim 1, wherein the displacement means comprises an electromagnetic device having a core displacement between first and second positions according to an operating state of the electromagnet, the core being operatively connected to the pivotably mounted counter roller such that the first arrangement of the displacement means corresponds to the first positio of the electromagnetic device and the second arrangement of the displacement means corresponds to the second position of the electromagnetic device.

4. The device according to claim 3, wherein the displacement means comprises a linearly elastic member disposed between the electromagnetic device and the pivotably mounted roller.

5. The device according to claim 1, wherein the motor is a stepping motor.

6. The device according to claim 5, further comprising control means for coordinatingly controlling the moveable accumulation guide, the operational state of the electromagnetic device, and motor.

7. A counter roller assembly comprising:

a plate having an aperture formed therethrough;

a freely rotatably roller mounted on a bracket, the bracket being pivotably connected to the plate so as to have a pivot axis substantially parallel to an axis of rotation of the roller such that the roller can be selectively exposed through the aperture of the plate depending on a pivot position of the bracket;

a mechanical link extending in a plane substantially parallel to a plane of the plate and in a direction substantially perpendicular to the pivot axis of the bracket, a degree of tension on the mechanical link corresponding directly to a force component extending perpendicular to and intersecting with the axis of rotation of the roller.

8. The assembly according to claim 7, further comprising an electromagnetic device having a core member that is displaceable between first and second positions depending on an operating state of the electromagnetic device, wherein the mechanical link is connected to the core member so as to selectively apply tension to the mechanical link depending on the operating state of the electromagnetic device.

9. The assembly according to claim 7, wherein the mechanical link comprises an axially resilient portion.

10. The assembly according to claim 9, wherein the axially resilient portion is a spiral spring.

11. A pinch roller drive assembly comprising:

a drive roller driven to rotate; and the counter roller assembly according to claim 7, wherein the drive roller and the freely rotatable roller are located in opposition, an amount of pressure applied between the drive roller and the freely rotatable roller being variable in accordance with a tension applied to the mechanical link.

12. The pinch roller drive assembly according to claim 11, further comprising an electromagnetic device having a core member that is displaceable between first and second positions depending on an operating state of the electromagnetic device, wherein the mechanical link is connected to the core member so as to selectively apply tension to the mechanical link depending on the operating state of the electromagnetic device.

13. The pinch roller drive assembly according to claim 12, further comprising control means for controlling an operation of the electromagnetic device.

14. The pinch roller drive assembly according to claim 12, wherein the control means controls the operation of the electromagnetic device in accordance with what is being driven between the drive roller and the freely rotatable roller.

15. A document folding and insertion machine comprising the document accumulation device of claim 1.

* * * * *